US011097268B2

(12) United States Patent
Sells et al.

(10) Patent No.: US 11,097,268 B2
(45) Date of Patent: Aug. 24, 2021

(54) MICROFLUIDIC FLOW CONTROL

(71) Applicant: Hewlett-Packard Development Company, L.P., Houston, TX (US)

(72) Inventors: Jeremy Sells, Corvallis, OR (US); Nick McGuinness, San Diego, CA (US); Chantelle Domingue, Corvallis, OR (US); Manish Giri, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 1007 days.

(21) Appl. No.: 15/546,352

(22) PCT Filed: Jan. 30, 2015

(86) PCT No.: PCT/US2015/013639

§ 371 (c)(1),
(2) Date: Jul. 26, 2017

(87) PCT Pub. No.: WO2016/122554

PCT Pub. Date: Aug. 4, 2016

(65) Prior Publication Data

US 2018/0015460 A1 Jan. 18, 2018

(51) Int. Cl.
*B01L 3/00* (2006.01)

(52) U.S. Cl.
CPC ..... *B01L 3/502715* (2013.01); *B01L 3/50273* (2013.01); *B01L 3/502746* (2013.01); *B01L 2200/14* (2013.01); *B01L 2200/143* (2013.01); *B01L 2300/023* (2013.01); *B01L 2300/024* (2013.01); *B01L 2300/0627* (2013.01); *B01L 2300/088* (2013.01); *B01L 2300/0867* (2013.01); *B01L 2300/1827* (2013.01); *B01L 2400/0439* (2013.01); *B01L 2400/0442* (2013.01)

(58) Field of Classification Search
None
See application file for complete search history.

(56) References Cited

U.S. PATENT DOCUMENTS 6,228,153 B1 5/2001 Saitoh
6,723,062 B1 4/2004 Westberg et al.
(Continued)

FOREIGN PATENT DOCUMENTS

CN 103003577 A 3/2013
JP 2012-177599 9/2012
(Continued)

OTHER PUBLICATIONS

Luc Gervais, "Capillary Microfluidic Chips for Point-of-care Testing: From Research Tools to Decentralized Medical Diagnostics"; Jun. 23, 2011.

*Primary Examiner* — Lyle Alexander
*Assistant Examiner* — Bryan Kilpatrick
(74) *Attorney, Agent, or Firm* — Perry + Currier Inc

(57) ABSTRACT

A device includes a microfluidic channel structure on a substrate with a first fluid actuator and a second fluid actuator within the microfluidic channel structure. One of the fluid actuators is selectively employable to at least partially reverse fluid flow within at least a portion of the microfluidic channel structure in response to a blockage or to prevent a blockage.

15 Claims, 7 Drawing Sheets

(56) References Cited

U.S. PATENT DOCUMENTS

| | | | | |
|---|---|---|---|---|
| 8,740,453 | B2 * | 6/2014 | Torniainen | F04B 13/00 374/31 |
| 2003/0002027 | A1 | 1/2003 | Fritz | |
| 2004/0246294 | A1 | 12/2004 | Mitsuzawa | |
| 2005/0092662 | A1 | 5/2005 | Gilbert et al. | |
| 2007/0003434 | A1 | 1/2007 | Padmanabhan et al. | |
| 2010/0319463 | A1 | 12/2010 | Richardson | |
| 2011/0100495 | A1 | 5/2011 | Welle | |
| 2011/0286493 | A1 * | 11/2011 | Torniainen | B41J 2/1404 374/33 |
| 2013/0061936 | A1 | 3/2013 | Govyadinov et al. | |
| 2013/0061962 | A1 | 3/2013 | Kornilovich et al. | |

FOREIGN PATENT DOCUMENTS

| | | | |
|---|---|---|---|
| JP | 2013-032994 | | 2/2013 |
| JP | 2013-533101 | A | 8/2013 |
| JP | 2016-520823 | | 7/2016 |
| TW | 201248148 | A | 12/2012 |
| TW | 201319563 | A | 5/2013 |
| TW | 201326814 | A | 7/2013 |
| WO | WO-2006133400 | | 12/2006 |
| WO | WO-2014178827 | | 11/2014 |
| WO | WO-2015116083 | A1 | 8/2015 |

* cited by examiner

MICROFLUIDIC FLOW CONTROL

BACKGROUND

Microfluidics applies across a variety of disciplines and involves the study of small volumes of fluid and how to manipulate, control and use such small volumes of fluid in various systems and devices, such as microfluidic chips. For example, in some instances a microfluidic chip may be used as a "lab-on-chip", such as for use in the medical and biological fields to evaluate fluids and their components.

DETAILED DESCRIPTION

Figure 1:
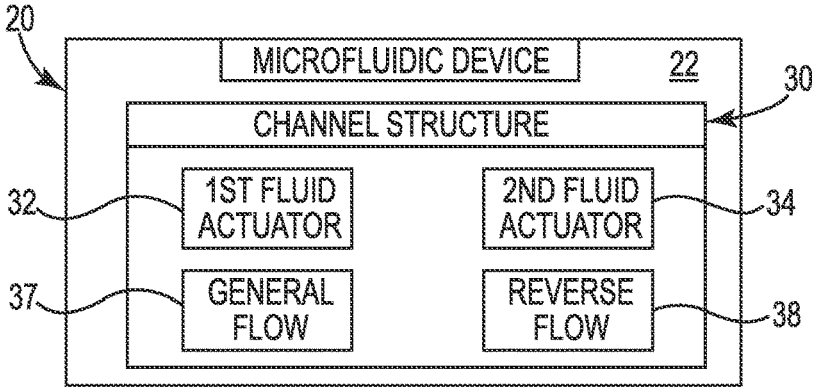
FIG. 1 is block diagram schematically illustrating a microfluidic device, according to an example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense.

At least some examples of the present disclosure are directed to microfluidic devices used to process and evaluate biologic fluids. In some examples, such processing and evaluation involves fluid flow control on the microfluidic device. Accordingly, at least some examples of the present disclosure involve controlling fluid flow within and throughout the channel structure(s) of a microfluidic device.

At least some examples of the present disclosure provide for managing fluid flow control by employment of additional fluid actuators that are in addition to any other fluid actuators that are primary in controlling fluid flow within and through a channel structure of a microfluidic device. Accordingly, such additional fluid actuators are sometimes referred to as being redundant in that the primary operations of the microfluidic device do not rely on such additional fluid actuators. Instead, such additional fluid actuators are selectively activated to temporarily modify a fluid flow within the microfluidic channel structure. In some examples, a substantial decrease occurs in an expected flow rate within the microfluidic channel structure, such as when a partial or complete blockage occurs within the microfluidic channel structure. By strategically locating the additional fluid actuator and selectively activating the additional fluid actuator upon occurrence of a blockage, the additional fluid actuator is used to temporarily and at least partially reverse the direction of fluid flow to clear the blockage.

In some examples, the second fluid actuator remains in a passive state until a substantial decrease of a rate of the fluid flow in the first direction occurs at which time the second fluid actuator causes the reverse fluid flow for a period of time and intensity appropriate to clear the blockage.

In some examples, this reverse fluid flow is limited to the area of the blockage, and therefore occurs in a localized area that does not otherwise substantially affect or alter the general fluid flow in a main flow direction within the microfluidic channel structure. However, in other examples, the additional fluid actuator is used to cause a complete reversal of the fluid flow within the microfluidic channel structure to clear the blockage. In other words, in a least a portion of the microfluidic channel structure, the general fluid flow is stopped and just the reverse fluid flow is active.

In some examples, changes in the flow direction and/or flow rate are detected via a fluid flow rate sensor within the microfluidic channel structure.

In some examples, once the additional fluid actuator acts to clear the blockage, then it is deactivated.

Accordingly, in some examples, fluid flow control is managed via removing blockages as they occur while otherwise maintaining a general fluid flow throughout the microfluidic channel structure to sustain desired fluidic operations.

In some examples, the additional or redundant fluid actuator is automatically activated at periodic intervals to cause a temporary, local reverse fluid flow within the general fluid flow and opposite to the direction of the general fluid flow to help prevent blockages and congestion within the microfluidic channel structure. In the event that a blockage occurs despite this preventative mode of the additional fluid actuator, the additional fluid actuator can be further selectively activated until the blockage clears.

These arrangements ensure robust operation of a microfluidic device, while ensuring consistent results to thereby make point-of-care diagnostic testing practical for real world, clinical settings and while doing so with relatively low cost test chips.

These examples, and additional examples, are described and illustrated in association with at least FIGS. 1-17.

FIG. 1 is a block diagram schematically illustrating a microfluidic device 20, according to an example of the present disclosure. As shown in FIG. 1, the microfluidic device 20 is formed on a substrate 22, and includes a microfluidic channel structure 30. The microfluidic channel structure 30 includes an arrangement to move fluid within microfluidic channels while performing different functions such as heating, pumping, mixing, and/or sensing to manipulate the fluid as desired to perform a test or evaluation of the fluid, or to execute a reaction process.

In some examples, the channel structure 30 includes a first fluid actuator 32 and a second fluid actuator 34. In general terms, the first fluid actuator 32 is positioned to cause a general fluid flow (37) in a first direction to implement operations within channel structure 30. Meanwhile, the second fluid actuator 38 is positioned to selectively and temporarily cause a reverse fluid flow (38) within channel structure 30. In some examples, the reverse fluid flow (38) occurs on a scale and a location that does not substantially alter the general fluid flow (37).

In some examples, the second fluid actuator is located at a position within the channel structure 30 that is spaced apart from position of the first fluid actuator by a distance sufficient to provide a localized reverse fluid flow (in the opposite direction), which is independent of the general fluid flow caused by first fluid actuator 32.

In some examples, the second fluid actuator 34 is activated at a substantially lower intensity (e.g. lower power, longer pulse width) than the intensity at which first fluid actuator 32 operates to maintain a general fluid flow through the channel structure 30.

In some examples, when selectively activated the fluid actuators 32, 34 cause selectable fluid displacements generally between 0.5 and 15 picoLiters and can be activated at a frequency ranging from 1 Hz to 100 kHz. In some examples, when selectively activated the second fluid actuator 34 cause fluid displacements of up to 100 picoLiters and can be activated at a frequency of 1 kHz to 100 kHz. Accordingly, in some examples, the second fluid actuator 34 can be operated in a single pulse mode in which a single, small magnitude single nucleating pulse is implemented to cause a single small pulse of reverse fluid flow to help clear a blockage but without substantially altering the general fluid flow. In some examples, the second fluid flow actuator 34 is operated in multi-pulse mode in which a series of spaced apart single, small magnitude single nucleating pulses are implemented to cause a series of small pulses of reverse fluid flow to help clear a blockage but without substantially altering the general fluid flow In some instances, the microfluidic device 20 is referred to as a microfluidic chip or a biologic test chip.

Further details regarding the role and attributes of the second fluid actuator 34 in fluid flow control of the channel structure 30 are described below.

Figure 2A:
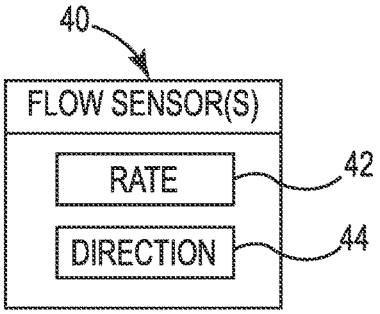
FIG. 2A is a block diagram schematically illustrating a fluid flow sensor associated with a microfluidic device, according to an example of the present disclosure.

As shown in FIG. 2A, in some examples the microfluidic channel structure 30 identified in FIG. 1 includes flow sensor(s) 40 to sense a rate 42 and/or a direction 44 of fluid flow. This information is used to identify unexpected changes in the fluid flow, such as but not limited to detecting a substantial change (e.g. decrease) in the general fluid flow rate within the microfluidic channel structure 30. In some examples, multiple fluid flow sensors 40 are spaced apart from each other and distributed throughout the channel structure 30 to facilitate identifying a precise location at which a blockage occurs.

In some examples, the second fluid actuator 34 comprises a plurality of second fluid actuators, and a determination regarding which second fluid actuators 34 will cause the reverse or secondary fluid flow is made according to a location of the respective second fluid actuators 34 relative to the sensed flow at a corresponding location of a respective one of the flow sensors 40.

Figure 2B:
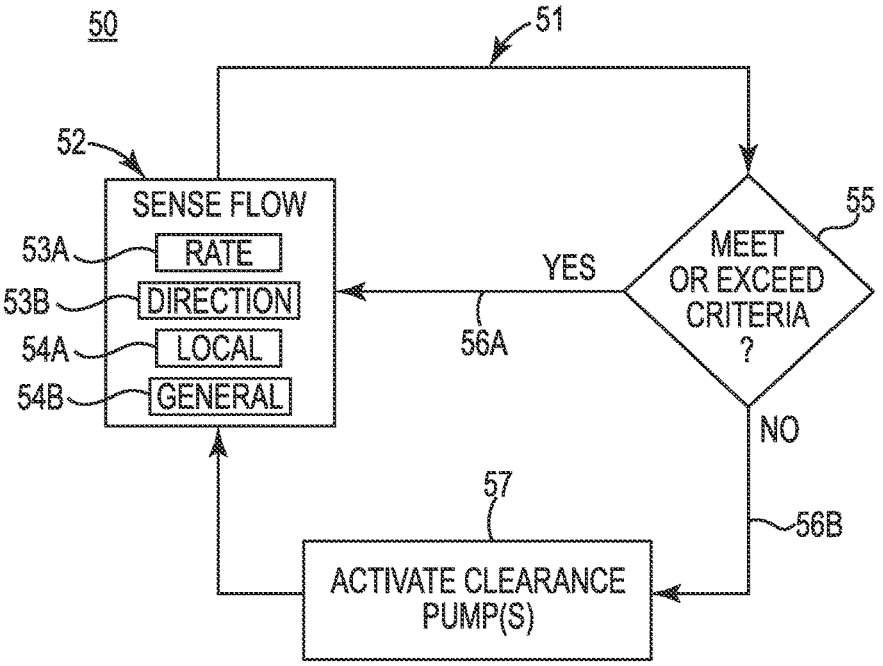
FIG. 2B is a diagram schematically illustrating a fluid flow feedback loop, according to an example of the present disclosure.

FIG. 2B is a flow diagram 50 schematically illustrating a fluid flow control feedback loop 51, according to an example of the present disclosure, in association with operation of the microfluidic device 20 as previously described in association with at least FIGS. 1-2A and later described in association with FIGS. 3-15. As shown at block 52 in FIG. 2B, a fluid flow within the microfluidic channel structure 30 may be sensed. In some examples, the sensed fluid flow is a general fluid flow 54B. In some examples, the sensed fluid flow is a local fluid flow 54A within a portion of the microfluidic channel structure 30.

The sensed fluid flow may identify a rate 53A and a direction 53B of the fluid flow, and whether the sensed fluid flow is a general fluid flow 54A or a local fluid flow 54B.

After sensing the fluid flow within microfluidic channel structure 30, at block 55 in FIG. 2B a determination may be made whether the sensed fluid flow meets or exceeds criteria, such as a minimum, a maximum or other parameter. For example, in order to perform tests or operations involving biologic particles within the microfluidic device 20, a minimum flow rate may be involved or a maximum flow rate may be involved, each of which facilitate the respective test or operation.

In some examples in which there may be multiple different target local fluid flows within the microfluidic channel structure 30, the determination at block 55 may query whether each of those local fluid flows meet or exceed the criterion for the particular location at which those fluid flows are measured.

If the answer to the query at block 55 is YES, path 56A is taken to block 52 for further fluid flow sensing. If the answer to the query at block 55 is NO, path 56B is taken to block 57 to cause activation of a clearance pump (e.g. second fluid actuator 34 in FIG. 1) to clear an expected blockage within microfluidic channel structure 30 and restore the fluid flow to the general operating conditions of microfluidic channel structure 30 per the criterion.

After such clearing activity via the second fluid actuator 34, control in loop 51 returns to block 55 for further fluid flow sensing.

By employing feedback loop 51, consistent and robust operation of the microfluidic device 20 may be maintained.

In some examples, at least some of the information relating to operation of feedback loop 51 is communicated from the microfluidic device 20 to external components and devices for further processing and control actions regarding the microfluidic device 20.

After providing further information in association with at least FIGS. 3-9 regarding a device environment in which the microfluidic device 20 may function, further details will be provided in association with at least FIGS. 10-15 regarding more features and attributes regarding fluid flow control of the microfluidic channel structure 30 and the second fluid actuator 34.

Figure 3:
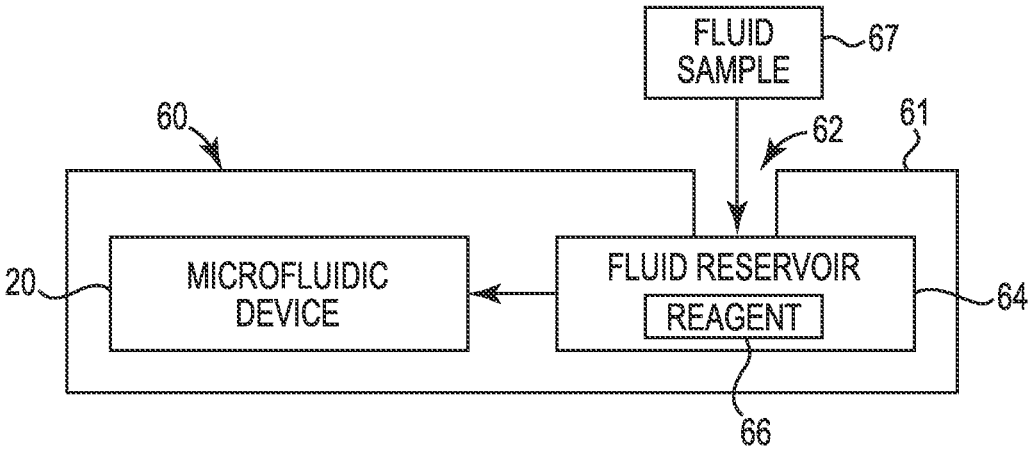
FIG. 3 is a flow diagram schematically illustrating a cassette housing a microfluidic device, according to an example of the present disclosure.

FIG. 3 is a block diagram schematically illustrating a module 60 including a microfluidic device 20 (FIGS. 1-2), according to an example of the present disclosure. In some instances, the module is referred to as a cassette or container. As shown in FIG. 3, module 60 includes a housing 61 that at least partially contains and/or supports microfluidic device 20.

In some examples, as shown in FIG. 3 fluid reservoir 64 is defined within housing 61 in close proximity to microfluidic device 20 to enable fluid communication therebetween. As shown via FIG. 3, the fluid sample 67 is deposited (via inlet 62) to enter fluid reservoir 64 and mix with reagent(s) 66 before flowing into microfluidic device 20. In some instances, microfluidic device 20 includes its own reservoir to initially receive the fluid sample (mixed with reagents 66) from reservoir 64 before the fluid flows into channels of the microfluidic device 20.

If the fluid sample 67 is blood, then in some examples the reagent(s) 66 includes an anti-coagulant, such as ethylenediamine tetraacetic acid (EDTA), and/or buffer solution such as phosphate buffered saline (PBS). In some examples, a suitable blood sample has volume of about 2 microliters while the reagent has a volume of about 8 microliters, leading to a volume of 10 microliters to be processed via the microfluidic device 20.

It will be further understood that when whole blood is the fluid sample 67, in some examples the reagent(s) 66 include other or additional reagents to prepare the blood for a diagnostic test of interest. In some examples, such reagent(s) 66 help sensors identify certain particles in the fluid sample in order to track them, count them, move them, etc. In some examples, such reagent(s) 66 bind with certain particles in the fluid sample 67 to facilitate excluding or filtering those certain particles from the fluid to better isolate or concentrate a particular biologic particle of interest. In some examples, the operation of the reagent(s) 66 works in cooperation with filters and/or other sorting and segregation mechanisms to exclude certain biologic particles from a sensing region of the microfluidic device 20.

In some examples, reagent(s) 66 include materials suitable to perform antibody-antigen binding for micro-particle tagging and/or materials suitable to implement nano-particle tagging techniques, magnetic particle sorting techniques, and/or high density particle tagging techniques.

In some examples, at least some reagent(s) 66 include lysing agents, such as (but not limited to) when it is desired to separate out red blood cells prior to implementing subsequent counting or analysis of white blood cells.

Of course, in the event that the fluid sample 67 is not blood but is a different biologic fluid, such as urine, spinal fluid, etc., then reagent(s) 66 would include an appropriate type and number of reagent(s) 66 suited to handling such fluids and to achieve the desired separation and sorting of the components of those fluids.

In some examples, reagent(s) 66 are provided to prepare for, initiate, execute, and/or terminate various reaction processes such as, but not limited to, processes to perform molecular diagnoses and related tasks as previously mentioned.

In some examples, a suitable blood sample (i.e. fluid sample 67) has volume of about 2 microliters while the reagent has a volume of about 8 microliters, leading to a volume of 10 microliters to be processed via the microfluidic device 20. Accordingly, in this arrangement, a dilution factor of about 5 is applied to the fluid sample of whole blood. In some examples, dilution factors of more than or less than 5 are applied to whole blood. In some examples, such low dilution factors ensure a high signal-to-noise ratio when a sense volume of the fluid (to be tested) passed through the sensing region at which target biological particles are counted. In addition, lower dilution factors involve a smaller total volume of fluid to be processed by the microfluidic device, which in turn reduces the total test time for the particular fluid sample. In some examples, a dilution factor that is equal to or less than ten is employed.

In some examples, whether the fluid sample 67 is blood or another type of biological fluid, volumes greater or less than 2 microliters can be used. In addition, in some examples, whether the fluid sample 67 is blood or another type of biologic fluid, reagent volumes greater or less than 8 microliters can be used. In some examples, a fluid sample 67 is also diluted with other or additional fluids other than reagents 66.

Figure 4A:
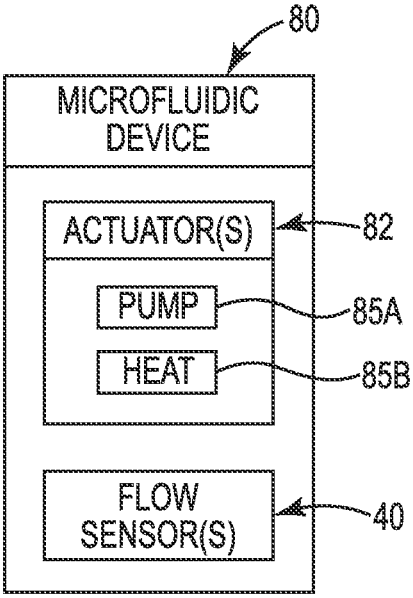
FIG. 4A is a block diagram schematically illustrating a microfluidic device, according to an example of the present disclosure.

FIG. 4A is a block diagram schematically illustrating a microfluidic device 80, according to an example of the present disclosure. In some examples, microfluidic device 80 includes at least some of substantially the same features and attributes as microfluidic device 20 of FIGS. 1-3. In some examples, at least some components of microfluidic device 80 of FIG. 4A are incorporated within the microfluidic device 20 of FIGS. 1-3.

As shown in FIG. 4A, microfluidic device 80 includes actuator(s) 82 and flow rate sensor(s) 84, with actuators 82 functioning as a pump 85A and/or as a heater 85B. In some examples, actuator 82 comprises a resistive element, such as a thermal resistor. When activated at a high intensity, and sufficient pulse width, the actuator 82 may cause formation of a nucleating vapor bubble that displaces fluid within the channel structure 30 to drive fluid along and through the channel structure 30. As a byproduct, a moderate amount of heat may be produced. In one aspect, such high intensity activation involves a relatively short pulse width, and higher power.

However, when activated at a significantly lower intensity and insufficient pulse width, the actuator 82 may not act as a pump because insufficient energy is present to cause significant fluid displacement. Instead, heat is produced, such that actuator 82 functions as a heater 85B without displacing fluid. In one aspect, such low intensity activation involves a relatively longer pulse width, and lower power.

In one example, the actuator(s) 82 corresponds to the first fluid actuator 32 and second fluid actuator 34 in FIG. 1.

In some examples, microfluidic device 80 includes fluid flow sensor(s) 40 (FIG. 2A) to sense fluid flow rate and direction within the microfluidic channel structure 30. In some examples, the fluid flow sensor(s) 40 is a sensor dedicated to sensing fluid flow and direction. In this sense, the fluid flow sensor(s) 40 is separate from, and independent of, other sensors such as attributes sensors (e.g. 83 in FIG. 4B). However, in some examples, the fluid flow sensor(s) 40 is at least partially implemented via functionality of an attribute sensor (83 in FIG. 4B). In some examples, a blockage or diminished fluid flow is at least partially identified via a value (or change in value) of a signal from an impedance sensor that is indicative of a lack of cells flowing near or over the sensor. In some examples, a blockage or diminished fluid flow is at least partially identified via detecting a temperature of the silicon substrate rising above a threshold temperature. Upon such identifications, the second fluid actuator 34 is activated as a redundant pump to cause fluid flow in the reverse direction.

In some examples, a fluid flow sensor 40 (whether dedicated or as part of an attribute sensor) includes electrodes arranged with an asymmetry that enables deducing the flow direction via signal analysis and/or analyzes a residence time of individual cells in the sensing zone over a certain time to determine a flow rate.

A later described control interface 106 is couplable to an electrical interface of the microfluidic device 20, 80 for energizing and controlling operations of the actuator(s) 82 and fluid flow sensor(s) 40.

In some examples, the structures and components of the chip-based microfluidic device 20, 80 are fabricated using integrated circuit microfabrication techniques such as electroforming, laser ablation, anisotropic etching, sputtering, dry and wet etching, photolithography, casting, molding, stamping, machining, spin coating, laminating, and so on.

Figure 4B:
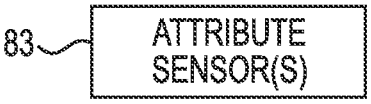
FIG. 4B is a block diagram schematically illustrating an attribute sensor of a microfluidic device, according to an example of the present disclosure.

FIG. 4B is a block diagram schematically illustrating an attribute sensor(s) 83 of a microfluidic device, according to an example of the present disclosure. In some examples, a microfluidic device such as device 20, 80 (FIGS. 1-4A) further includes an attribute sensor(s) 83 to detect pH, identification of particular biologic particles, temperature, cell count, etc. In some examples, the attribute sensor 83 comprises an impedance sensor. In some examples, the attribute sensor 83 can function as a flow sensor 40. In some examples, the attribute sensor 83 is separate from and independent of a dedicated flow sensor 40.

Figure 5:
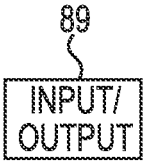
FIG. 5 is a block diagram schematically illustrating an input/output element of a microfluidic device, according to an example of the present disclosure.

FIG. 5 is a block diagram schematically illustrating an input/output element 89 of a microfluidic device such as the microfluidic device 20, 80 in FIGS. 1-4A, according to an example of the present disclosure. The input/output element 89 enables communication of data, power, control signals, etc. to/from external devices, which facilitate operation of the microfluidic device 20, 80, and which are further described later in association with at least FIGS. 7-10.

Figure 6:
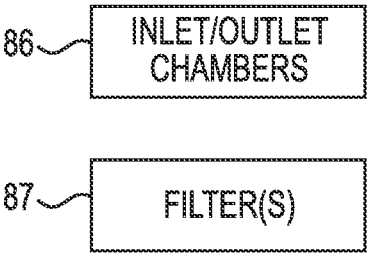
FIG. 6 is a block diagram schematically illustrating components of a microfluidic device, according to an example of the present disclosure.

FIG. 6 is a block diagram schematically illustrating components 86, 87 of a microfluidic device, according to an example of the present disclosure. In some examples, a microfluidic device such as device 20, 80 (FIGS. 1-4C) further includes inlet/outlet chambers 86 and/or filters 87. The inlet/outlet chambers enable fluid to enter and exit various portions of the channel structure 30 while filters 87 segregate different components of a fluid from each other, such as excluding larger particles from further passage through the microfluidic channel structure 30, as further noted later.

Figure 7:
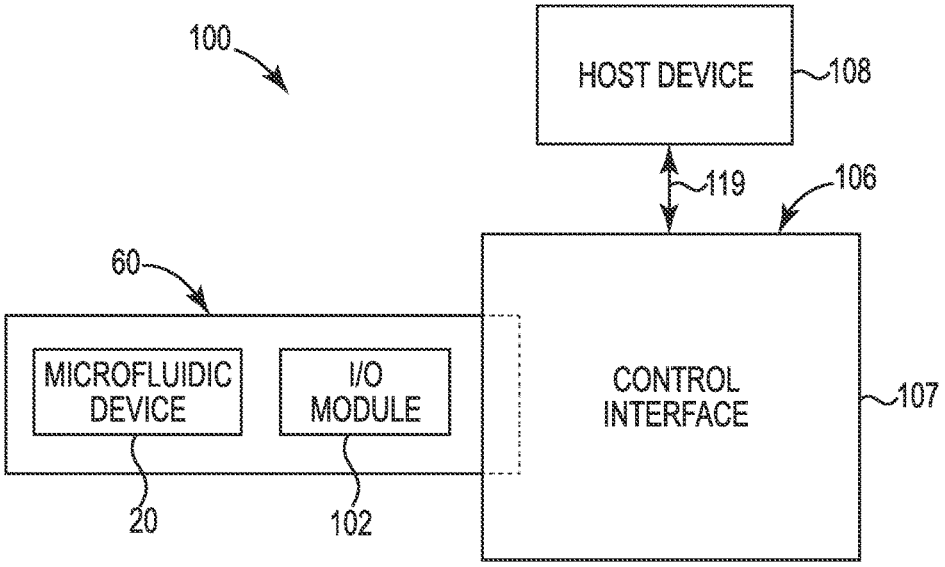
FIG. 7 is a block diagram schematically illustrating a microfluidic test system, according to an example of the present disclosure.

FIG. 7 is a block diagram schematically illustrating a microfluidic test system 100, according to an example of the present disclosure. As shown in FIG. 7, system 100 includes a cassette 60, a control interface 106 (with housing 107), and a host device 108. In some examples, cassette 60 includes at least some of substantially the same features and attributes as cassette 60, as previously described in association with at least FIG. 3, and with microfluidic device 20 including at least some of substantially the same features and attributes as microfluidic device 20, 80, as previously described in association with at least FIGS. 1-6.

As shown in FIG. 7, in addition to at least microfluidic device 20, cassette 60 includes an input/output (I/O) module 102 to communicate power, data, and/or control signals, etc. between the microfluidic device 20 (within cassette 60) and the control interface 106, which is in turn in communication with the host device 108. In some examples, the I/O module 102 of cassette 60 interfaces with the I/O element 89 of microfluidic device 80 (FIG. 4A).

In some examples, as shown in FIG. 7, cassette 60 is removably couplable to the control interface 106 so that it can be coupled and uncoupled as desired. The control interface 106 is removably couplable to the host device 108 as further described below. In some instances, the control interface 106 is referred to as, or embodied as, a dongle or connector.

In general terms, a fluid sample 67 (FIG. 3) is processed through microfluidics and subject to various functions or reaction processes before being exposed to a sensing region in the microfluidic device 20 under control of the control interface 106. The microfluidic device 20 provides an electrical output signal representing the sensor data to the control interface 20. With the control interface 20 under control of the host device 108, the host device 108 may send and receive data to and from the control interface 106, including command information for controlling the microfluidic device 20, for performing thermal management of substrate 22, and/or obtaining sensor data obtained from the microfluidic device 20.

Figure 8:
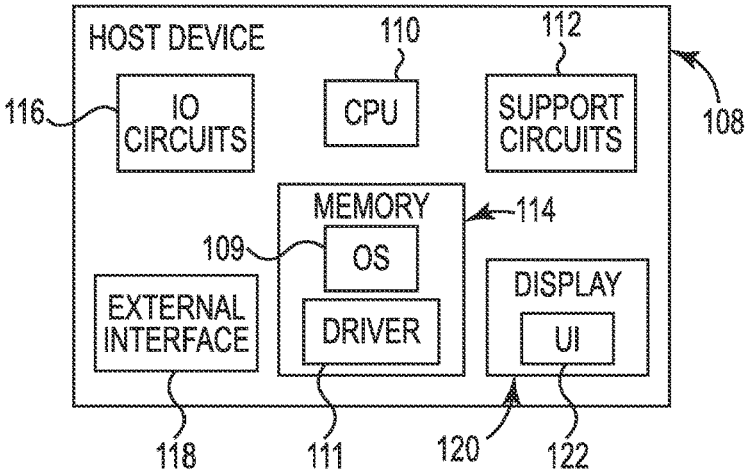
FIG. 8 is a block diagram schematically illustrating a host device of the system of FIG. 7, according to an example of the present disclosure.

FIG. 8 is a block diagram schematically illustrating the host device 108 (FIG. 7), according to an example of the present disclosure. As shown in FIG. 8, in some examples, the host device 108 generally includes a central processing unit (CPU) 110, various support circuits 112, memory 114, various input/output (IO) circuits 116, and an external interface 118. The CPU 110 includes a microprocessor. In some examples, the support circuits 112 include a cache, power supplies, clock circuits, data registers, and the like. In some examples, the memory 114 includes random access memory, read only memory, cache memory, magnetic read/write memory, or the like or any combination of such memory devices. In some examples, the IO circuits 116 cooperate with the external interface 118 to facilitate communication with the control interface 106 over a communication medium 119 (shown in FIG. 7). The communication medium 119 can involve any type of wired and/or wireless communication protocol and can include electrical, optical, radio frequency (RF), or the like transfer paths.

In some examples, the external interface 118 includes a universal serial bus (USB) controller capable of sending and receiving data to the control interface 106, as well as providing power to the control interface 106, over a USB cable. It is to be understood that in some examples, other types of electrical, optical, or RF interfaces to the control interface 106 are used to send and receive data and/or provide power.

In some examples, as shown in FIG. 8, the memory 114 of host device 108 stores an operating system (OS) 109 and a driver 111. The OS 109 and the driver 111 include instructions executable by the CPU 110 for controlling the host device 108 and for controlling the control interface 106 through the external interface 118. The driver 111 provides an interface between the OS 109 and the control interface 106. In some examples, the host device 108 comprises a programmable device that includes machine-readable instructions stored on non-transitory processor/computer readable-media (e.g., the memory 114).

In some examples, as shown in FIG. 8, the host device 108 includes a display 120 through which the OS 109 can provide a graphical user interface (GUI) 122. A user can use the user interface 122 to interact with the OS 109 and the driver 111 to control the control interface 106, and to display data received from the control interface 106. It will be understood that the host device 108 can be any type of general or specific-purposed computing device. In an example, the host device 108 is a mobile computing device, such as a "smart phone," "tablet" or the like.

Figure 9:
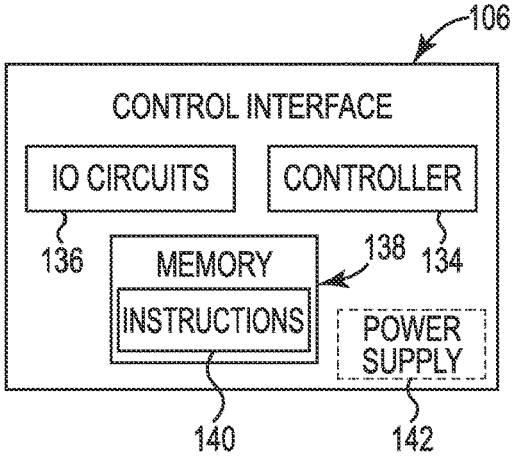
FIG. 9 is a block diagram schematically illustrating a control interface of the system of FIG. 7, according to an example of the present disclosure.

FIG. 9 is a block diagram schematically illustrating the control interface 106, according to an example of the present disclosure. In one example, the control interface 106 includes a controller 134, IO circuits 136, and a memory 138. The controller 134 comprises a microcontroller or microprocessor. In some examples, control interface 106 receives power from the host device 108, while in some examples, the control interface 106 includes a power supply 142.

In some examples, memory 138 stores instructions 140 executable by the controller 134 for at least partially controlling the microfluidic device 20 and/or for communicating with the host device 108. As such, the control interface 106 comprises a programmable device that includes machine-readable instructions 140 stored on non-transitory processor/computer readable-media (e.g., the memory 138). In other examples, the control interface 106 may be implemented using hardware, or a combination of hardware and instructions 140 stored in memory 138. For instance, in some examples all or a portion of the control interface 106 is implemented using a programmable logic device (PLD), application specific integrated circuit (ASIC), or the like.

In some examples, driver 111 in memory 114 of host device 108 and/or memory 138 of control interface 106 stores machine readable instructions to implement and/or operate fluid flow control management for microfluidic channel structure 30. In some examples, such fluid flow management is at least partially implemented via a fluid flow control manager 350, as later further described in association with at least FIG. 13A.

Figure 10:
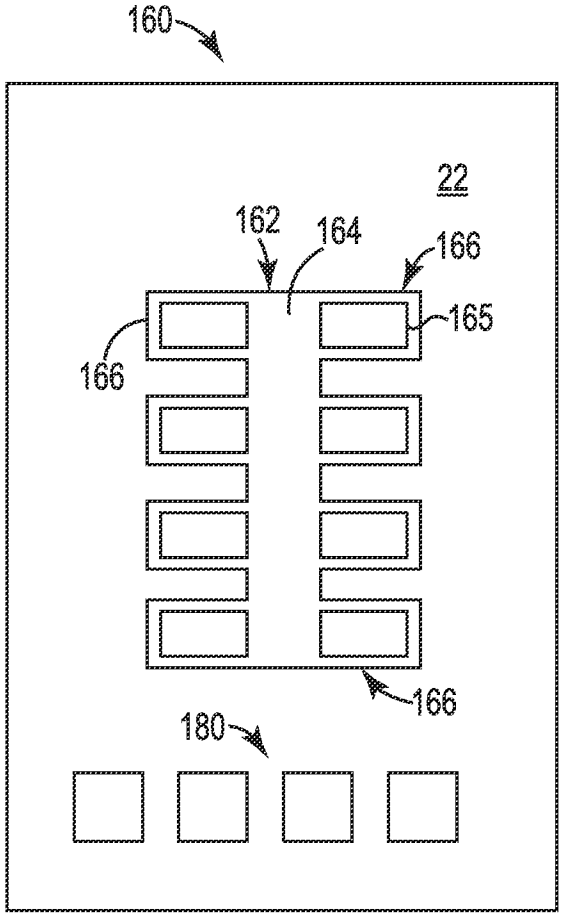
FIG. 10 is a top plan view schematically illustrating a microfluidic device, according to an example of the present disclosure.

FIG. 10 is a top plan view illustrating a microfluidic device 160, according to an example of the present disclosure. In some examples, the microfluidic structure 160 includes at least some of substantially the same features and attributes as the microfluidic devices (e.g. 20, 80) as previously described in association with at least FIGS. 1-9, and therefore is suited to implement fluid flow control as described throughout the present disclosure.

As shown in FIG. 10, microfluidic device 160 includes a substrate 22 on which is formed microfluidic channel structure 162, and input/output portion 180. As noted previously, in some examples the substrate is made of a silicon material.

As shown in FIG. 10, the microfluidic channel structure 162 includes an array of microfluidic channel units 166 arranged about and in fluid communication with centrally located reservoir 164. It will be understood, however, that the units 166 are not strictly limited to the particular size, shape, and position shown in FIG. 10, and instead can exhibit other sizes, shapes, and positions.

In some examples, the microfluidic channel units 166 are generally independent of each other and a flow rate and direction of the fluid flow for each respective channel unit 166 is managed independently from the other respective channel units 166.

Figure 11:
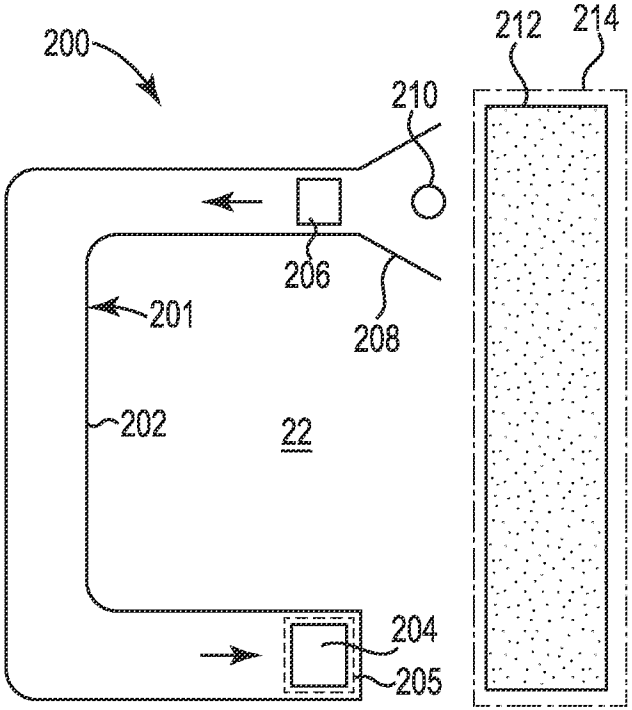
FIG. 11 is a top plan view schematically illustrating a portion of a microfluidic device including a channel structure and associated components, according to an example of the present disclosure.

FIG. 11 is a diagram schematically illustrating a microfluidic structure 200 of a portion of a microfluidic device 20, according to an example of the present disclosure, and which provides just one example implementation of a respective one of microfluidic channel units 166 in FIG. 10.

As shown in FIG. 11, in some examples the microfluidic structure 200 includes a microfluidic channel 202, a first fluid actuator 204, an attribute sensor 206, a nozzle 205 (e.g., outlet), and an inlet 208. FIG. 10 also depicts a fluid reservoir 214, which is in communication with the fluid reservoir 64 of cassette 60 (FIG. 3). In some examples, channel 202 corresponds to a respective one of the channels 165 (of a microfluidic channel unit 166) in FIG. 10.

In some examples, as further shown in FIG. 11 a mesh filter 212 is provided in the fluid reservoir 214 for filtering particles in the applied fluid sample. While the shape of the fluid channel 202 in FIG. 10 is shown as being "U-shaped", this is not intended as a general limitation on the shape of the channel 202. Thus, the shape of the channel 202 can include other shapes, such as curved shapes, serpentine shapes, shapes with corners, combinations thereof, and so on, some of which are further described and illustrated later in association with FIGS. 12A-12B, 14-15. In addition, different portions of channel 202 can vary in width. Moreover, the channel 202 is not shown to any particular scale or proportion. The width of the channel 202 as fabricated on a device can vary from any scale or proportion shown in the drawings of this disclosure. The arrows in the channel indicate an example direction of fluid flow through the channel.

The inlet 208 provides an opening for the channel 202 to receive the fluid. The filter 210 is disposed in the inlet 208 and prevents particles in the fluid of a particular size (depending on the size of the filter 210) from entering the channel 202. In some examples, the inlet 208 can have a larger width and volume than the channel 202.

In some examples, the attribute sensor 206 is disposed in the channel 202 near the inlet 208 (e.g., closer to the inlet 208 than the pump actuator 204) as shown in FIG. 10. In some examples, the attribute sensor 206 is disposed in the inlet 208. In some examples, the attribute sensor 206 is an impedance sensor and detects impedance changes as biologic particles in the fluid pass over the sensor 206.

As further shown in FIG. 11, in some examples first fluid actuator 204 (e.g. pump) is disposed near a closed end of the channel 202 downstream from the attribute sensor 206. The first fluid actuator 204 can be a fluidic inertial pump actuator, which can be implemented using a wide variety of structures. In some examples, the first fluid actuator 204 is a thermal resistor that produces a nucleating vapor bubble to create fluid displacement within the channel 202. The displaced fluid is ejected from the nozzle 405, thereby enabling an inertial flow pattern within/through channel 202. In some examples, first fluid actuator 204 is implemented as piezo elements (e.g., PZT) whose electrically induced deflections generate fluid displacements within the channel 202. Other deflective membrane elements activated by electrical, magnetic, and other forces are also possible for use in implementing the first fluid actuator 204.

In general terms, the fluid actuator 204 is positioned in sufficiently close proximity to attribute sensor 206 to ensure high fluid flow rates near attribute sensor 206. Although not shown, in some examples, first fluid actuator 204 is positioned to cause inertial pumping that pushes biologic particles through the region at sensor 206 while in some examples, fluid actuator 204 is positioned to cause inertial pumping that pulls biologic particles through the region at attribute sensor 206, as shown in FIG. 11.

Consistent with the previously described microfluidic device (20 in FIG. 1-2A, 80 in FIG. 4A), when operated at a longer pulse width and intensity, the first fluid actuator 204 also acts a heater to heat fluid within channel 202. As previously noted, in such instances the first fluid actuator 204 is operated in a pulse mode in which the activation occurs at a lower intensity, and a longer pulse width to provide a pulse of heat to the fluid without forming a nucleating bubble.

In some examples, channel 202 includes more than one first fluid actuator 204, such that more than one fluid actuator is arranged within a single channel 202 to control a general fluid flow within channel structure 200.

Figure 12A:
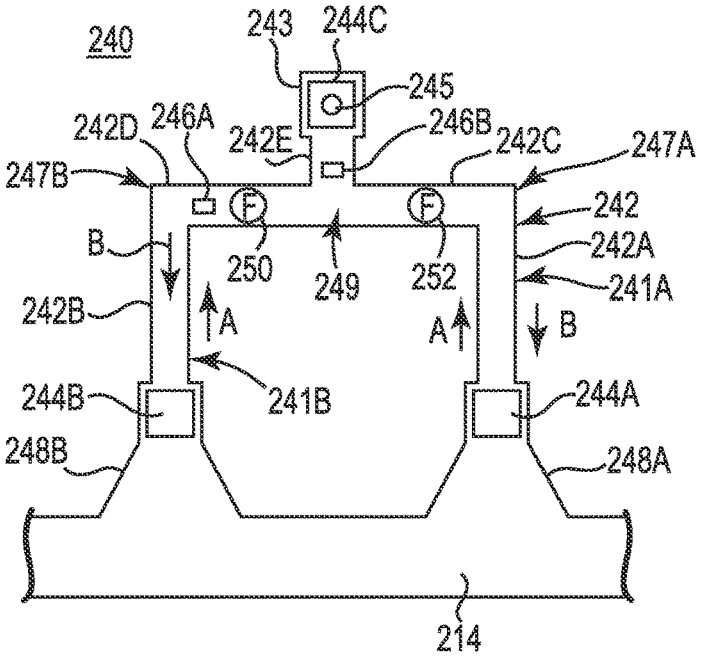
FIG. 12A is a top plan view schematically illustrating a portion of a microfluidic device including a channel structure and associated components, according to an example of the present disclosure.

FIG. 12A is a top plan view schematically illustrating a microfluidic device 240, according to an example of the present disclosure. In some examples, microfluidic device 240 includes at least some of substantially the same features and attributes as microfluidic device 160 (as previously described in association with at least FIG. 10) and as the general components of channel structure 200 in FIG. 11.

As shown in FIG. 12A, in some examples microfluidic channel structure 240 includes a first channel 242 including a first branch 241A and a second branch 241B that connect and lead (via segment 242E) to an end portion 243. First branch 241A includes inlet 248A and channel segments (i.e. portions) 242A, 242C while second branch 241B includes inlet 248B and segments 242B, 242D. A junction 249 is formed at an intersection of segments 242D, 242C, and 242E.

In some examples, a first attribute sensor 246A is located within segment 242D while a second attribute sensor 246B is located within segment 242E.

A first actuator fluid actuator 244C (like first fluid actuator 32 in FIG. 1) is located within end portion 243 with a nozzle 245 (represented by a circle superimposed on the square representing actuator 244C) also located in end portion 243. In operation, activation of first fluid actuator 244C pulls fluid from reservoir 214 through the branches 241A, 241B of channel 242, with fluid passing over attribute sensors 246A, 246B before the fluid exits channel 242 via nozzle 245.

In some examples, at least one fluid flow sensor (F) 250 (or 252) is located within channel 242. In the particular example implementation, fluid flow sensor (F) 250 is shown in channel segment 242D downstream from and adjacent to attribute sensor 246A, but upstream from junction 249. In some examples, a second fluid flow sensor 252 (or 250) is located within channel 242. In one particular example implementation shown in FIG. 12A, the second fluid flow sensor 252 is located within channel segment 242C upstream from junction 249.

Each branch 241A, 241B includes a respective second fluid actuator 244A, 244B (like second fluid actuator 34) positioned near a first end of the respective segments 242A, 242B.

In operation, a main flow occurs in the direction represented by directional arrow A with first fluid actuator 244C pulling fluid through the branches 241A, 241B.

In some examples, the blockage is identified via one or both of the flow sensors 250, 252 positioned with respective segments 242D, 242C. While a blockage could potentially occur at any one of several locations along channel 242, in some examples junction 249 presents a location at which a blockage might be more likely to occur because of the pair of ninety degree turns made by channel segments 242C, 242D and the momentum of fluid flow from each of those respective segments 242C, 242D meeting each other.

However, in some instances in which a blockage forms in channel 242, then one or both of second fluid actuators 244A, 244B are activated to cause a reverse fluid flow in direction B (opposite to direction A) for a temporary period of time sufficient to clear the blockage. In some examples, the main flow caused by first fluid actuator 244C is maintained during the activation of second fluid actuators 244A and/or 244B.

In one example implementation a blockage near junction 249 is cleared via activation of just one of second fluid actuators 244A, 244B, which pulls the fluid and elements involved in the blockage in a single direction away from junction 249, while at least some of the main flow along direction A is still pulled toward end portion 243 via the continued activation of first fluid actuator 244C. After clearing the blockage, the particular second fluid actuator (one of 244A, 244B) is deactivated.

By providing a respective one of the pair of second fluid actuators 244A, 244B in different branches, one of those second fluid actuators 244A, 244B is selectable depending on which one would likely cause a faster, more effective clearance of the blockage.

Figure 12B:
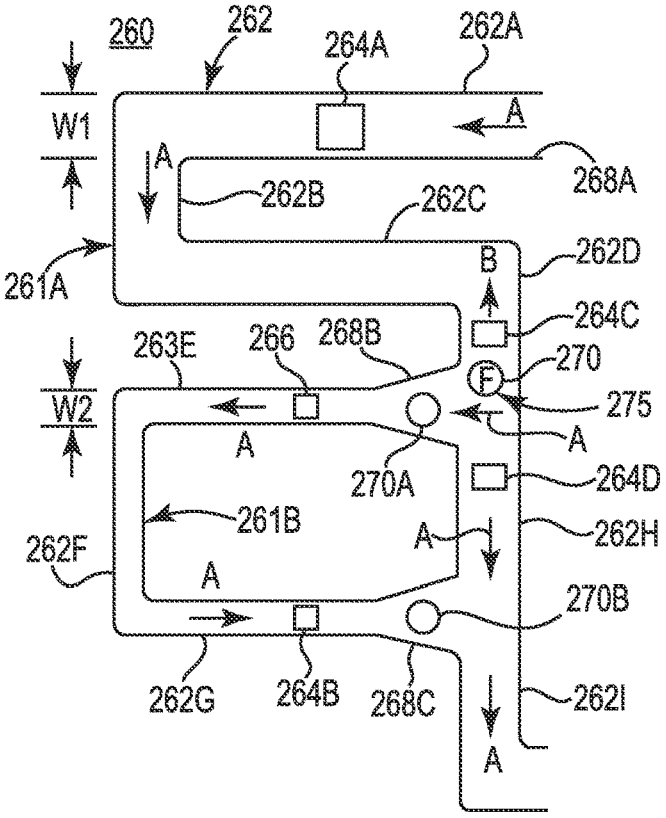
FIG. 12B is a top plan view schematically illustrating a portion of a microfluidic device including a channel structure and associated components, according to an example of the present disclosure.

FIG. 12B is a top plan view schematically illustrating a microfluidic device 260, according to an example of the present disclosure. In some examples, microfluidic device 260 includes at least substantially the same features and attributes as microfluidic device 160 as previously described in association with at least FIG. 10 and as the general components of channel structure 200 in FIG. 11.

As shown in FIG. 12B, in some examples microfluidic channel structure 260 includes a first channel 262 including a main branch 261A and a second branch 261B that extends off and returns to the main branch 261A. Main branch 241A includes inlet 268A and channel segments (i.e. portions) 262A, 262B, 262C, 262D, 262H, 262I. Second branch 241B begins via inlet 268B extending from main branch 261A at junction 275, with second branch 241B further including segments 262E, 262F, and 262G before re-joining segment 262I of main branch 261A. Junction 275 is located at the intersection of segments 262D, 262E, and 262H.

In some examples, a first attribute sensor 266 is located within segment 262E and filter 270A is located at inlet 268B downstream from the first attribute sensor 266.

In some examples, a fluid flow sensor 270 is located within main branch 261A upstream from the inlet 268B of second branch 241B to monitor flow parameters near junction 275.

A first actuator fluid actuator 264A (like first fluid actuator 32 in FIG. 1) is located within initial segment 262A of main branch 261A and causes fluid flow in direction A via causing inertial pumping of fluid through main branch 241A via induced fluid flow from reservoir 214 into channel 262 to push fluid in first fluid flow direction A. A portion of the fluid flow in main branch 241A is diverted into second branch 241B.

In some examples, another first fluid actuator 264B in segment 262G of second branch 261B acts to induce fluid flow into second branch 261B. The smaller width of second branch 261B and filter 270A permit smaller particles to enter second branch 261B with those particles passing over attribute sensor 266 in segment 262E of second branch 261B. Any larger particles not of a size suitable to enter second branch 261B will continue in the main fluid flow in channel segments 262G, 262H.

In some examples, at least one fluid flow sensor 270 is located within channel 262. In the particular example implementation, fluid flow sensor 270 is shown in channel segment 262D upstream from junction 275. While not shown in FIG. 12B, it will be understood that in some examples additional fluid flow sensors can be located at various positions within channel 262 to sense a general fluid flow and/or to identify localized blockages at positions other than junction 275.

In some examples, as shown in FIG. 12B, a second fluid actuator 264C (like second fluid actuator 34) is positioned upstream from and in close proximity to junction 275 and flow sensor 270.

In operation, a main flow occurs in the direction represented by directional arrow A in the manner generally described above.

In some examples, a blockage is identifiable via flow sensor 270. While a blockage could potentially occur at any one of several locations along channel 262, in some examples junction 275 presents a location at which a blockage might be more likely to occur because of the pair of ninety degree turns made by channel segments 262D, 262H in joining to segment 262E of second branch 261B, because the width (W2) of the channel segments of second branch 261B are narrower than a width (W1) of the main branch 261A, and/or because of the presence of filter 270A in the inlet 268B of second branch 261B.

Following this non-limiting example in which a blockage forms in channel 262 near junction 275, then a second fluid actuator 264C (like second fluid actuator 34 in FIG. 1) is activated to cause a reverse fluid flow in direction B (opposite to direction A) for a temporary period of time sufficient to clear the blockage. In some examples, the main flow caused by first fluid actuators 264A, 264B are maintained during the activation of second fluid actuator 264C. After clearing the blockage, the second fluid actuator 264C is deactivated.

In some examples, another second fluid actuator 264D is present and activated generally contemporaneously with second fluid actuator 264C. The second fluid actuator 264D is located downstream from junction 275 and from second fluid actuator 264C, and when activated, second fluid actuator 264D helps to maintain the main fluid flow in direction A during the temporary reverse flow (in direction B) caused by second fluid actuator 264C.

Figure 13A:
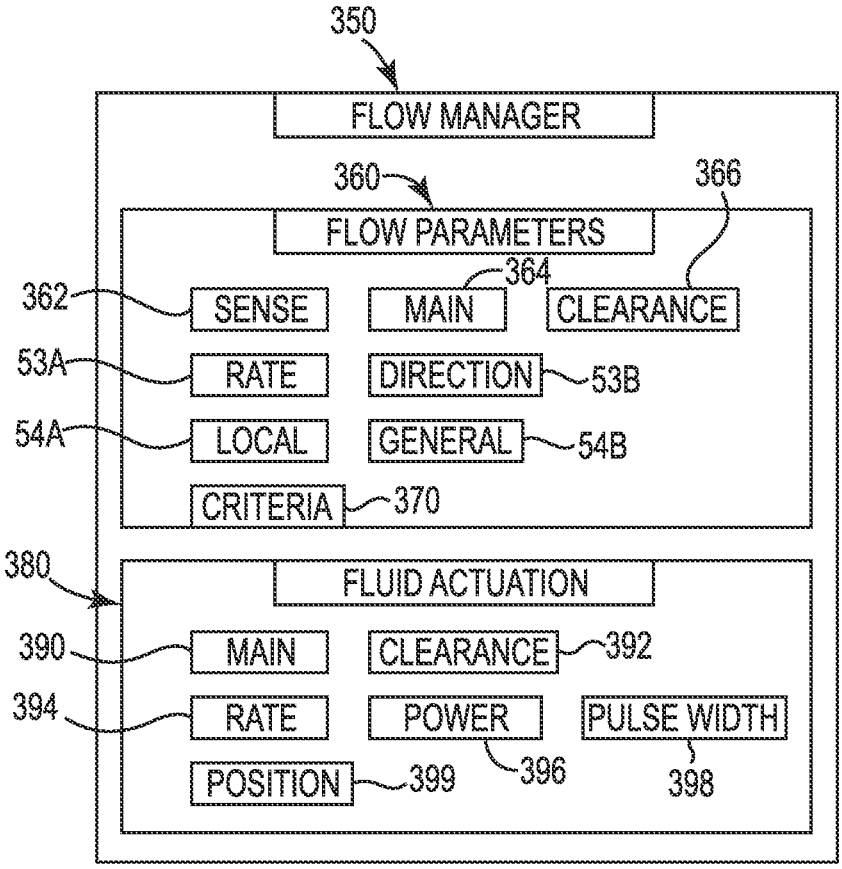
FIG. 13A is a block diagram schematically illustrating a fluid flow manager, according to an example of the present disclosure.
Figure 14:
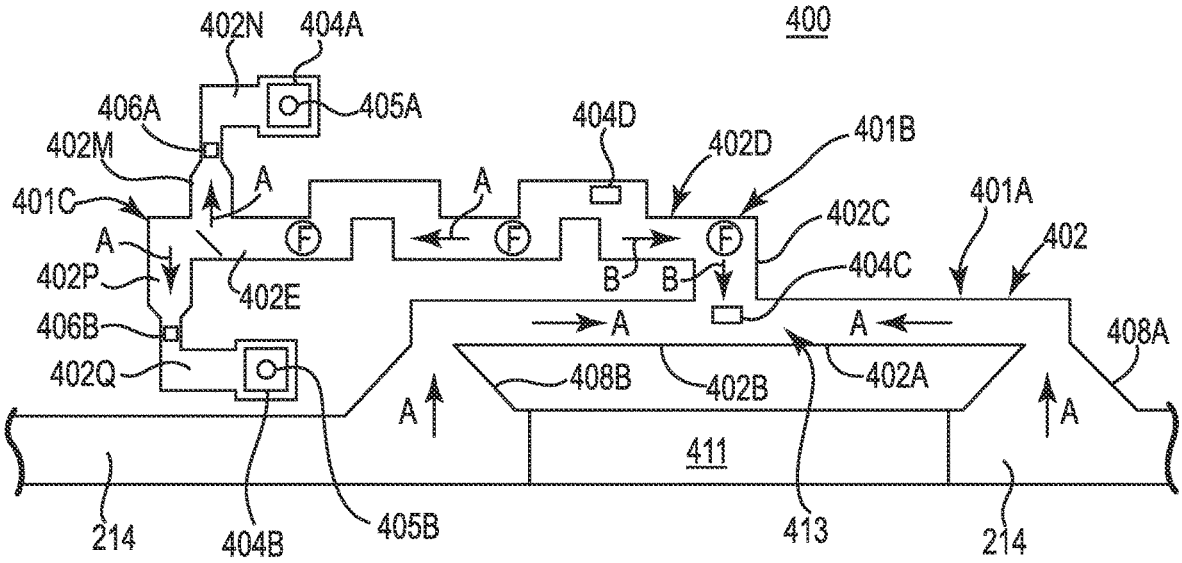
FIG. 14 is a top plan view schematically illustrating a portion of a microfluidic device including a channel structure and associated components, according to an example of the present disclosure.

FIG. 13A is a block diagram of a fluid flow manager 350, according to an example of the present disclosure. In some examples, fluid flow control manager 350 operates in association with at least some of the features and attributes as the microfluidic devices previously described in association with at least FIGS. 1-12B. In general terms, in some examples the fluid flow control manager 350 at least partially manages a fluid flow within a microfluidic device channel structure via sensing fluid flow rates and direction, and selectively reversing fluid flow via a second or redundant fluid actuator. As shown in FIG. 14, fluid flow control manager 350 includes a flow parameters module 360 and fluid actuation module 380.

As shown in FIG. 13A, flow parameters module 360 includes a sense function 362, a main function 364, and a clearance function 366. Rate parameter 53A, direction parameter 53B, a local parameter 54A, a general parameter 54B, and a criteria parameter 370.

Via a flow sensor 40, the sense function 362 operates to sense fluid flow within a microfluidic channel structure according to at least the flow rate parameter 53A (FIGS. 2B, 13A) and flow direction parameter 53B (FIGS. 2B, 13). The sense function 362 can sense flow locally (54A in FIGS. 2B, 13A) and/or in general (54B in FIGS. 2B, 13A). The criteria parameter 370 enables setting criteria regarding a desired or acceptable flow rate or flow direction to which the sensed flow information will be compared, such as in block 55 of feedback loop 51 in FIG. 2B.

The main function 364 provides for a primary or main fluid flow pattern within and throughout a microfluidic channel structure 30 as implemented via a primary fluid actuator (e.g. first fluid actuator 32 in FIG. 1), while the clearance function 366 provides for an auxiliary (e.g. reverse) fluid flow pattern within at least a portion of the channel structure 30 as implemented via an additional fluid actuator (a second fluid actuator 34 in FIG. 1) to clear blockages and/or prevent blockages.

The main function 364 and clearance function 266 operate according to the rate parameter 53A, direction parameter 53B, local parameter 54A, and general parameter 54B as previously described in association with at least FIG. 2B.

As further shown in FIG. 13A, the fluid actuation module 380 includes a main function 390 and a clearance function 392 with a rate parameter 394, a power parameter 396, a pulse width parameter 398, and a position parameter 399. The main function 390 implements activation of first fluid actuator 32 to produce the main fluid flow operations, while clearance function 392 selectively reverses a portion of the fluid flow. The respective main and clearance functions 390, 392 are implemented according to at least a rate parameter 394, a power parameter 396, a pulse width parameter 398, and a position parameter 399 of the respective fluid actuators employed. The rate parameter 394 controls a rate of activation of the fluid actuators (32, 34 in FIG. 1, 82 in FIG. 4A), which can range from 1 Hz to 100 kHz while power parameter 396 controls the amplitude of power applied to fluid actuators. In the event that a microfluidic channel structure includes more than one fluid actuator (whether a first fluid actuator or second fluid actuator 34), the position parameter 399 enables selection of which fluid actuator is activated based on the position of each respective fluid actuator within the channel structure.

In some examples, fluid flow control manager 350 resides within machine readable instructions stored in a memory associated with a controller, such as the memory 138 of control interface 106 and/or memory 114 of host device 108. Via the connections and communication pathways previously described in association with at least FIG. 3, fluid flow control manager 350 at least partially controls fluidic operations of microfluidic device 20, 80, 160 to help maintain consistent fluid flow during operations within microfluidic channel structure 30 (FIG. 1-2A), 162 (FIG. 10).

Figure 13B:
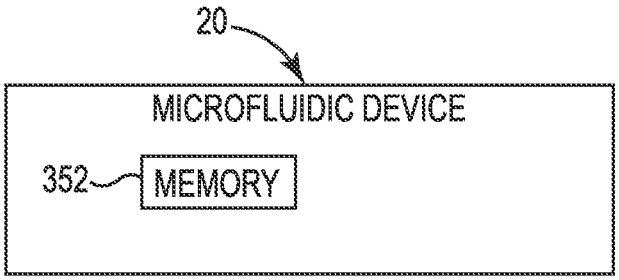
FIG. 13B is a block diagram schematically illustrating a microfluidic device including at least a memory, according to an example of the present disclosure.

In some examples, at least some of the functionality of fluid flow control manager 350 resides on microfluidic device 20 (FIGS. 1-12B, 14-15), such as via storage of machine readable instructions (to implement those functions) in a memory 352 on microfluidic device 20, as shown in FIG. 13B with memory 352 having at least some of substantially the same features and attribute as memory 114 (FIG. 8) or memory 138 (FIG. 9). In such examples, the functionality of fluid flow control manager 350 on microfluidic device 20 would complement or cooperate with any functionality of fluid flow control manager 350 remaining on control interface 106 (FIG. 9) and/or host device 108 (FIG. 8). In some examples, all of the functionality of fluid flow control manager 350 would be stored in memory 352 of microfluidic device 20. In some examples, when such memory 352 is present on microfluidic device 20, microfluidic device 20 also includes a controller or circuitry having some control functionality having at least some of substantially the same features as controller 134 of control interface 106 (FIG. 9) and/or controller functionality (e.g. CPU 110) of host device 108 (FIG. 8)

FIG. 14 is a top plan view of a channel structure 400 of a microfluidic device, according to an example of the present disclosure. In some examples, the microfluidic device including channel structure 400 includes at least some of substantially the same features and attributes as microfluidic device 160 (as previously described in association with at least FIG. 10) and as the general components of channel structure 200 in FIG. 11.

As shown in FIG. 14, in some examples microfluidic channel structure 400 includes a first channel 402 including a first portion 401A, a second portion 401B, and a third portion 401C. First portion 401A includes inlets 408A, 408B and channel segments 402A, 402B. Second portion 401B includes segment 402C and multi-turn segment 402D, which includes a series of ninety degree turns before end segment 402E of second portion 401B joins to third portion 401C. Third portion 401C includes two oppositely extending segments 402M and 402P, which each include a respective attribute sensor 406A, 406B and a respective end segment 402N, 402Q. Each end segment 402N, 402Q includes a respective first fluid actuator 404A, 404B and a respective fluid exit nozzle 405A, 405B.

In operation, activation of first fluid actuators 404A, 404B induces fluid flow from reservoir 214 into and through the segments 402A, 402B of first portion 401A, and then through second portion 401B and third portion 401C at which the fluid passes over one of the respective attribute sensors 406A, 406B before exiting nozzles 405A, 405B.

In some examples, at least one fluid flow sensor (F) is located within channel 402. In the particular example implementation shown in FIG. 14, at least one fluid flow sensor (F) is shown in second portion 401B upstream from the attribute sensors 406A, 406B. Moreover, in some examples as shown in FIG. 14, several flow sensors (F) are included in channel 402 and distributed along the length of one of the portions 401A, 401B, 401C of channel 402. In one example implementation, at least some of the flow sensors (F) are located at or near some of the ninety-degree turns along channel segment 402D of second portion 401B.

In some examples, a second fluid actuator 404D (like second fluid actuator 34 in FIG. 1) is positioned between a couple of the flow sensors (F) and upstream from the attribute sensors 406A, 406B.

In some examples, another second fluid actuator 404C is positioned at a junction 413 of channel segments 402A, 402B and 402C, which is upstream of all of the several flow sensors (F).

In operation, a main flow occurs in the direction represented by directional arrow A with first fluid actuators 404A, 404B inducing fluid flow through the channel 402 in the manner previously noted.

In some examples, a blockage is identifiable via at least some of the flow sensors (F) positioned with respective segment 402D of second portion 401B. In some examples, a blockage is identifiable via flow sensor (F) near junction 413 for substantially the same reasons noted above in association with junction 249 in FIG. 12A. As previously noted, blockages are identifiable in other locations within channel 402.

In instances in which a blockage forms in channel 402, then one or both of second fluid actuators 404C, 404D are activated to cause a reverse fluid flow in direction B (opposite to direction A) for a temporary period of time sufficient to clear the blockage. In some examples, the main flow caused by first fluid actuators 404A, 404B is maintained during the activation of second fluid actuators 404C, 404D. It will be understood that in some example implementations just one of second fluid actuators 404C, 404D are included in microfluidic channel structure 400.

After clearing a blockage, the particular second fluid actuator(s) 404C and/or 404D is then deactivated.

Figure 15:
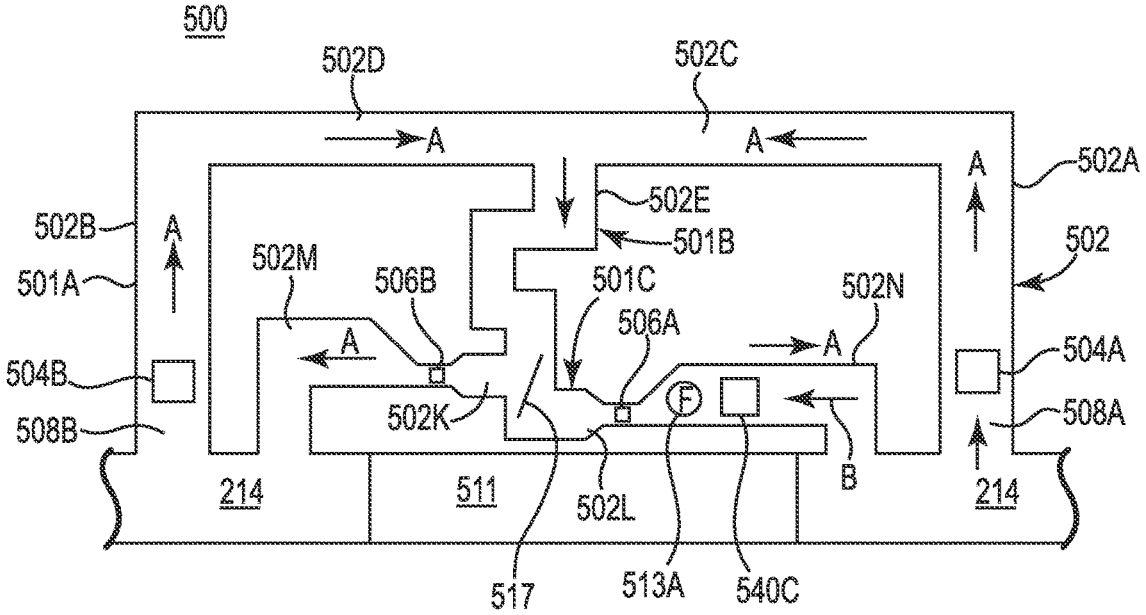
FIG. 15 is a top plan view schematically illustrating a portion of a microfluidic device including a channel structure and associated components, according to an example of the present disclosure.

FIG. 15 is a top plan view of a channel structure 500 of a microfluidic device, according to an example of the present disclosure. In some examples, the microfluidic device including channel structure 500 includes at least substantially the same features and attributes as microfluidic device 160 (as previously described in association with at least FIG. 10) and as the general components of channel structure 200 in FIG. 11.

As shown in FIG. 15, in some examples microfluidic channel structure 500 includes a first channel 502 including a first portion 501A and a second portion 501B, and third portion 501C. First portion 501A includes inlets 508A, 508B and channel segments 502A, 502B, which join via common segment 502C. Second portion 501B includes multi-turn segment 502E, which includes a series of ninety degree turns before joining to third portion 501C. Third portion 501C include two oppositely extending segments 502K and 502L, which each include a respective attribute sensor 506A, 506B and a respective 502M, 502N downstream from the respective sensors 506A, 506B.

In operation, activation of first fluid actuators 504A, 504B induces fluid flow from reservoir 214 into and through the segments 502A, 502B of first portion 501A, and then through second portion 501B and third portion 501C at which the fluid passes over one of the respective attribute sensors 506A, 506B.

In some examples, at least one fluid flow sensor (F) is located within channel 502. In the particular example implementation shown in FIG. 15, a fluid flow sensor (F) 513A is shown in third portion 501C downstream from attribute sensor 506A. It will be understood that in some examples a similar fluid flow sensor (F) can be positioned downstream of attribute sensor 506B.

In some examples, channel 502 can include additional fluid flow sensors located in at least some of the positions in the previously described examples in association with at least FIGS. 1-14.

In operation, a main flow occurs in the direction represented by directional arrow A with first fluid actuators 504A, 504B inducing fluid flow through the channel 502 in the manner previously noted.

In some examples, a blockage is identifiable via at least some of the flow sensor (F) positioned with respective segment 502L in third portion 501C of channel 502. As previously noted, other blockages are potentially identifiable in other locations within channel 502 via an appropriately located fluid flow sensor (F).

In instances in which a blockage forms in channel 502, such as near attribute sensor 506A, then second fluid actuator 504C is activated to cause a reverse fluid flow in direction B (opposite to direction A) for a temporary period of time sufficient to clear the blockage. In some examples, the main flow caused by first fluid actuators 504A, 504B is maintained during the activation of second fluid actuator 504C. After clearing a blockage, the second fluid actuator(s) 504C is then deactivated.

At least some examples of the present disclosure provide for fluid flow control of a microfluidic channel structure, including additional or redundant fluid actuator(s) to clear blockages and/or to prevent formation of blockages.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A system comprising:

a biologic test chip comprising:

a substrate;

a microfluidic channel structure formed on the substrate, the channel structure including a reservoir and a first channel extending from the reservoir; and first and second fluid actuators positioned within the first channel, the first fluid actuator in a first position to selectively cause general fluid flow in a first direction from the reservoir into the first channel and the second fluid actuator in a second position to selectively cause reverse fluid flow in an opposite second direction at a same time of general fluid flow in the first direction without substantially altering the general fluid flow in the first direction; and a controller configured to temporarily activate the second fluid actuator to cause the reverse fluid flow in the opposite second direction at the same time of general fluid flow in the first direction in response to detection of a substantial decrease in a rate of the fluid flow in the first direction, the controller configured to deactivate the second fluid actuator in response to detection of a target flow rate of the general fluid flow.

2. The system of claim 1, comprising:

an attribute sensor positioned within the first channel, wherein the second position is upstream from the attribute sensor.

3. The system of claim 1, comprising:

an attribute sensor positioned within the first channel, wherein the second position is downstream from the attribute sensor.

4. The system of claim 1, comprising:

an attribute sensor positioned within the first channel; and at least one fluid flow sensor located in the first channel to detect the substantial decrease in the rate of the fluid flow in the first direction, wherein the at least one fluid flow sensor is spaced apart from and independent of the at least one attribute sensor.

5. The system of claim 4, wherein the at least one fluid flow sensor includes a plurality of flow sensors distributed between the respective first and second ends.

6. The system of claim 5, wherein the second fluid actuator comprises a plurality of second fluid actuators, and wherein a determination regarding which second fluid actuators will cause the secondary fluid flow is made according to location of the respective second fluid actuators relative to the sensed flow at a corresponding location of a respective one of the flow sensors.

7. The system of claim 1, wherein the second fluid actuator remains in a passive state until the substantial decrease of the rate of the fluid flow in the first direction occurs at which time the second fluid actuator causes the reverse fluid flow for a selectable period of time and intensity sufficient to ameliorate the substantial decrease.

8. A biologic microfluidic device comprising:

a substrate;

a microfluidic channel structure on the substrate;

a first fluid actuator to cause primary fluid flow in a first direction within the channel structure;

a second fluid actuator to cause secondary fluid flow in an opposite, second direction within the microfluidic channel structure;

at least one fluid flow sensor; and a controller configured to control the at least one fluid flow sensor to sense, during operation of the first fluid actuator, whether a substantial change occurs in at least one of a flow rate and a flow direction of the primary fluid flow within the channel structure, wherein the controller is further to control the second fluid actuator to remain inactive until determination of the substantial change, activate in response to the determination of the substantial change to cause the secondary fluid flow in the second direction, and return to an inactive state upon restoration of a target flow rate and direction of the primary fluid flow.

9. The biologic microfluidic device of claim 8, wherein the at least one fluid flow sensor includes a plurality of fluid flow sensors distributed in a spaced apart relation throughout the channel structure, and wherein the second fluid actuator comprises a plurality of second fluid actuators, and wherein a determination regarding which second fluid actuators will cause the secondary fluid flow is made according to location of the respective second fluid actuators relative to the sensed flow at a corresponding location of a respective one of the flow sensors.

10. The device of claim 8, wherein the first fluid actuator is activatable at a first level to produce a flow rate and direction sufficient to establish the generalized fluid flow, and wherein the second fluid actuator is activatable at a second level substantially less than the first level to produce the secondary fluid flow.

11. The biologic microfluidic device of claim 8, comprising:

an input/output module to communicate feedback loop information regarding the sensed fluid flow to enable the controller to initiate a command signal to selectively cause the secondary fluid flow.

12. The biologic microfluidic device of claim 8, wherein the microfluidic channel structure comprises an array of independent microfluidic channel units and wherein the flow rate and direction of the fluid flow for each respective channel unit is managed independently from the other respective channel units.

13. A device comprising:

a substrate;

a microfluidic channel structure formed on the substrate, the channel structure including a reservoir and a first channel extending from the reservoir;

at least two fluid actuators positioned within the first channel, including:

a first fluid actuator in a first position to cause general fluid flow in a first direction from the reservoir into the first channel; and a second fluid actuator in a second position to automatically, at periodic intervals, cause localized reverse fluid flow in an opposite second direction to prevent blockages;

at least one fluid flow sensor to sense at least whether a substantial change occurs in at least one of the flow rate and direction of the general fluid flow within the channel structure; and an input/output module to communicate with a controller configured to control the second fluid actuator to remain inactive until determination of the substantial change of the general fluid flow, activate in response to the determination of the substantial change to cause the localized reverse fluid flow in the second direction, and deactivate upon restoration of the general fluid flow.

14. The device of claim 13, wherein the first fluid actuator is activatable at a first level to produce a flow rate and direction sufficient to establish the general fluid flow, and wherein the second fluid actuator is activatable at a second level substantially less than the first level to produce the localized reverse fluid flow.

15. The device of claim 13, wherein upon sensing of a substantial change in the flow rate and direction of the general fluid flow, the second fluid actuator is selectively activated to a higher power and pulse width sufficient to restore the flow rate and direction of the general fluid flow.

* * * * *